US009752759B2

(12) United States Patent
Ito et al.

(10) Patent No.: US 9,752,759 B2
(45) Date of Patent: Sep. 5, 2017

(54) LIGHT EMISSION DEVICE AND LAMP UNIT

(71) Applicant: KOITO MANUFACTURING CO., LTD., Tokyo (JP)

(72) Inventors: Toru Ito, Shizuoka (JP); Haruhiko Iyoda, Shizuoka (JP); Hironori Tsukamoto, Shizuoka (JP); Masaya Shido, Shizuoka (JP); Yoshiro Ito, Shizuoka (JP); Yukihiro Onoda, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 0 days.

(21) Appl. No.: 15/209,286

(22) Filed: Jul. 13, 2016

(65) Prior Publication Data

US 2016/0320027 A1 Nov. 3, 2016

Related U.S. Application Data

(63) Continuation of application No. 14/641,561, filed on Mar. 9, 2015.

(30) Foreign Application Priority Data

Mar. 10, 2014 (JP) ..... 2014-046416

(51) Int. Cl.
*F21V 15/01* (2006.01)
*F21V 3/02* (2006.01)
(Continued)

(52) U.S. Cl.
CPC ..... *F21V 15/01* (2013.01); *F21V 3/02* (2013.01); *H05B 33/145* (2013.01); *H05B 33/22* (2013.01);
(Continued)

(58) Field of Classification Search
None
See application file for complete search history.

(56) References Cited

U.S. PATENT DOCUMENTS

2001/0053082 A1* 12/2001 Chipalkatti ..... B60Q 1/26 362/496
2010/0293782 A1 11/2010 Yamazaki et al.
(Continued)

FOREIGN PATENT DOCUMENTS

CN 102916033 A 2/2013
JP 2013-045523 A 3/2013

OTHER PUBLICATIONS

United States Office Action in related U.S. Appl. No. 14/641,561, mailed Nov. 4, 2016 (9 pages).
(Continued)

*Primary Examiner* — Ashok Patel
(74) *Attorney, Agent, or Firm* — Osha Liang LLP

(57) ABSTRACT

A lamp unit has an organic EL panel in which an organic EL light emission portion is formed on a substrate, the organic EL panel being flexible, and a frame that fixes the light emission device so as to cover a light emission area of the organic EL, panel. The frame has a window or a transparent portion at least in a part of a portion, overlapping the light emission area, of the frame. The frame is formed with recess portions at both ends thereof to house both end portions of the organic EL panel.

5 Claims, 8 Drawing Sheets

(51) Int. Cl.

| | |
|---|---|
| ***H05B 33/28*** | (2006.01) |
| ***H05B 33/14*** | (2006.01) |
| ***H05B 33/24*** | (2006.01) |
| ***H05B 33/22*** | (2006.01) |
| *F21Y 115/20* | (2016.01) |
| *F21Y 105/00* | (2016.01) |

(52) U.S. Cl.
CPC ..... *H05B 33/24* (2013.01); *H05B 33/28* (2013.01); *F21Y 2105/00* (2013.01); *F21Y 2115/20* (2016.08)

(56) References Cited

U.S. PATENT DOCUMENTS

| | | | | |
|---|---|---|---|---|
| 2011/0249450 | A1* | 10/2011 | Ngai | F21S 8/026 362/311.06 |
| 2012/0044618 | A1 | 2/2012 | Lee | |
| 2012/0126693 | A1 | 5/2012 | Seo et al. | |
| 2013/0034685 | A1 | 2/2013 | An et al. | |
| 2013/0049570 | A1 | 2/2013 | Natsume | |
| 2014/0009914 | A1 | 1/2014 | Cho et al. | |
| 2014/0133073 | A1 | 5/2014 | Ahn et al. | |
| 2014/0339574 | A1* | 11/2014 | Kang | H01L 27/124 257/88 |
| 2016/0290586 | A1* | 10/2016 | Shido | F21S 48/212 |

OTHER PUBLICATIONS

Office Action issued in corresponding Chinese Application No. 201510102465.2, mailed on Jul. 27, 2016 (13 pages).

* cited by examiner

LIGHT EMISSION DEVICE AND LAMP UNIT

CROSS REFERENCE TO RELATED APPLICATION(S)

This application is based on and claims priority under 35 U.S.C. §119 to Japanese Patent Application No. 2014-046416 filed on Mar. 10, 2014, the entire contents of which are incorporated herein by reference.

BACKGROUND

Technical Field

Exemplary embodiments of the invention relate to a light emission device including an organic EL panel and a lamp unit using the light emission device.

Related Art

Vehicle lamp units have been known which use, as a light source, a surface light emission element such as an organic EL panel. JP 2013-45523 A (corresponding to US 2013/0049570 A) describes a method of fixing a surface light emission element into a frame-shaped bracket (bezel) that is formed to conform to an outer circumferential shape of the surface light emission element.

SUMMARY

Because of their flexible structures, it is difficult to fix flexible organic EL panels to frames etc. correctly and firmly. Where an organic EL panel is not well fixed to an frame or the like (for example, where only the four corners of an organic EL panel are fixed), the organic EL panel might deviate from the frame due to vibration, the organic EL panel itself might warp due to vibration or the like, which might result in that a desired level of luminous intensity cannot be obtained or that the organic EL panel is damaged.

One exemplary embodiment of the invention has been made in view of the above circumstances and provides a technique for fixing a flexible organic EL panel correctly and firmly.

(1) According to one exemplary embodiment, a light emission device includes an organic EL panel and a molding resin. In the organic EL panel, an organic EL light emission portion is formed on a substrate. The organic EL panel is flexible. The molding resin shapes the organic EL panel (10) so that the organic EL panel is in a curved state.

With this configuration, since the organic EL panel is firmed with the molding resin, it is possible to correctly and firmly fix the organic EL panel which is in the curved shape.

(2) The light emission device of (1) may further include a power supply portion for the organic EL light emission portion. The power supply portion is covered with the molding resin.

With this configuration, the power supply portions can be protected by the molding resin.

(3) A lamp unit includes the light emission device of any one of (1) and (2), and a frame. The frame fixes the light emission device so as to cover a light emission area of the light emission device. The frame has a window or a transparent portion at least in a part of a portion, overlapping the light emission area, of the frame.

With this configuration, light emitted from the light emission area can be projected through the frame.

(4) In the lamp unit of (3), the transparent portion of the frame may have a convex portion or a concave portion.

With this configuration, the high-quality design of the lamp unit can be provided, and the frame can be given a lens function.

(5) In the lamp unit of any one of (3) and (4), the light emission device may be formed with an attachment hole that passes through the organic EL panel and the molding resin. The frame may include an attachment leg configured to be fitted into the attachment hole.

With this configuration, the light emission device can be attached to the frame without using any other fixing member.

(6) In the lamp unit of any one of (3) and (4), the molding resin of the light emission device may include an attachment leg made of the molding resin. The frame may be formed with an attachment hole to which the attachment leg is fitted.

With this configuration, the light emission device can be attached to the frame without using any other fixing member.

Exemplary embodiments of the invention make it possible to fix a flexible organic EL panel correctly and firmly.

DETAILED DESCRIPTION

Figure 1:
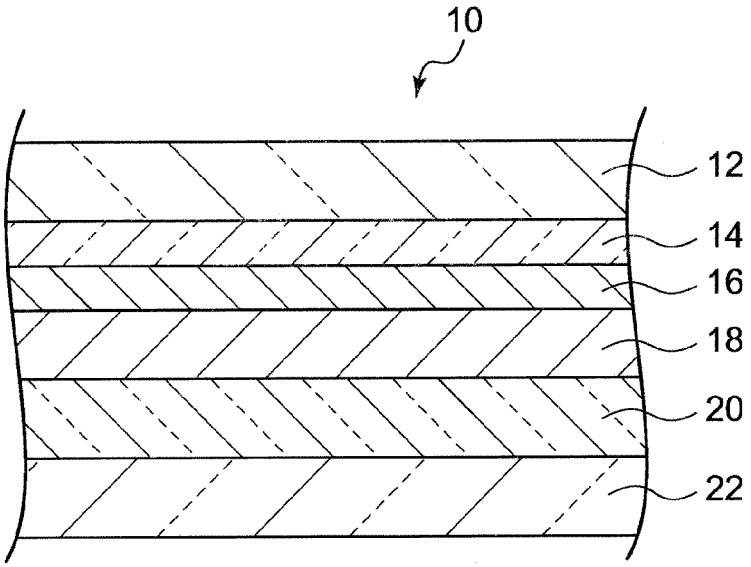
FIG. 1 is a sectional view showing a schematic configuration of an organic EL panel that is used in respective exemplary embodiment of the invention.

FIG. 1 is a sectional view showing a schematic configuration of an organic EL panel 10 that is used in respective exemplary embodiments (which will be described later) of the invention. The organic EL panel 10 has such a structure that an anode layer 14 which is a transparent conductive film (for example, an ITO film), a micro-reflective metal film 16, an organic EL light emission layer 18, and a cathode layer 20 which is a backside conductive film are laminated between (i) a front resin substrate 12 which is entirely or partially transparent and (ii) a rear resin substrate 22. The organic EL panel 10 is flexible. The organic EL panel 10 can be used in a curved form.

A process of manufacturing the organic EL panel 10 may include laminating the lamination structure from the anode layer 14 to the cathode layer 20 on either the front resin substrate 12 or the rear resin substrate 22. That is, the process of manufacturing the organic EL panel 10 may include forming the organic EL light emission layer 18 (which is an example of an organic EL light emission portion) on either the front resin substrate 12 or over rear resin substrate 22.

A flexible glass substrate or a metal substrate may be used in place of the front resin substrate 12 and the rear resin substrate 22.

A micro-cavity structure is formed by providing the micro-reflective metal film 16 between the anode layer 14 and the organic EL light emission layer 18. A distance between the micro-reflective metal film 16 and the cathode layer 20 is selected in accordance with a wavelength of light that is to be emitted from the organic EL light emission layer 18. Because of the micro-cavity structure, the light emitted from the organic EL light emission layer 18 is repeatedly reflected between the micro-reflective metal film 16 and the cathode layer 20, and only light having a particular resonance wavelength is amplified. Thereby, the luminance of the light emission portion can be enhanced. The organic EL panel 10 may be configured in such a manner that the micro-reflective metal film 16 is not provided between the anode layer 14 and the organic EL light emission layer 18.

Although not shown in FIG. 1, power supply portions that supply power to the organic EL light emission layer 18 are formed at plural positions on a peripheral portion of the front or rear surface of the organic EL panel 10.

As described above, it is difficult to fix a flexible organic EL panel correctly and firmly, which might cause various issues. In one exemplary embodiment of the invention, the organic EL panel 10 which is in a desired curved state is shaped together with a molding resin, whereby a rigid light emission device is produced.

Figure 2C:
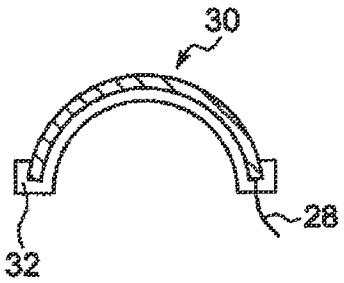
FIGS. 2A to 2C illustrate a process of manufacturing a light emission device according to a first exemplary embodiment of the invention.
Figure 2B:
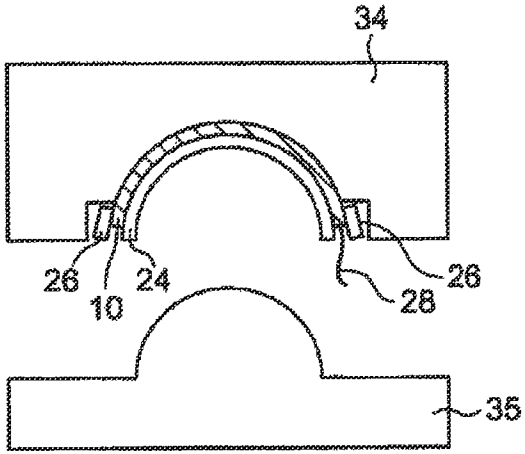
Figure 2A:
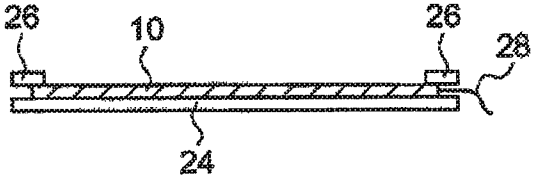

FIGS. 2A to 2C illustrate a process of manufacturing a light emission device according to a first exemplary embodiment of the invention.

At first, as shown in FIG. 2A, a molding resin 24 which is formed into a sheet shape slightly larger than the organic EL panel 10 is bonded to one surface of the organic EL panel 10. Then, molding resins 26 each of which is formed into an elongated and narrow strip shape are bonded to both ends of the organic EL panel 10. For example, the molding resins 24, 26 are a thermoplastic resin such as polypropylene, ABS, or polycarbonate. A power supply cable 28 is connected to the power supply portions (not shown) of the organic EL panel 10.

Subsequently, as shown in FIG. 2B, the organic EL panel 10 and the molding resins 24, 26 are placed in a female die 34 having a desired shape. Then, the female die 34 is combined with a corresponding male die 35, and the dies 34, 35 are heated, whereby the molding resins 24, 26 are thermally welded together.

Subsequently, the dies 34, 35 are cooled and removed. Thereby, a light emission device 30 which is firmed in a curved state is obtained as shown in FIG. 2C. Connection portions between the power supply portions and the power supply cable 28 are also covered with the molding resin.

Figure 3:
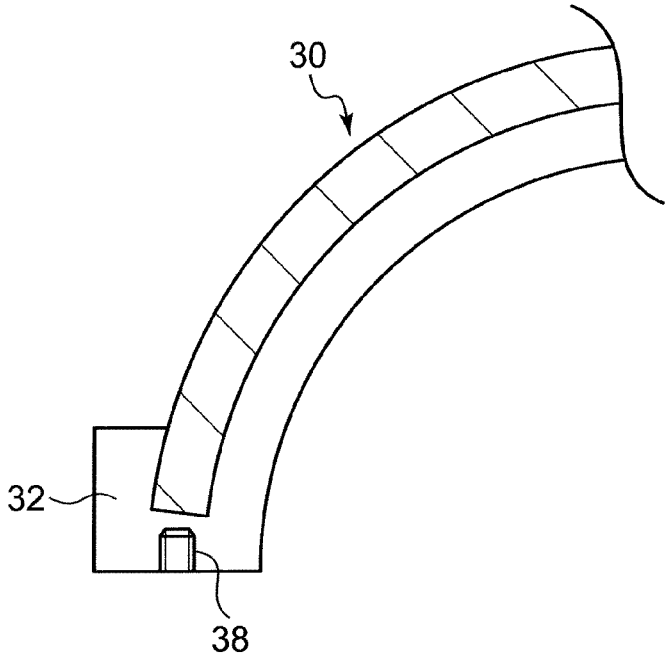
FIG. 3 is an enlarged view showing an attachment portion of the light emission device.

In the illustrated manufacturing process according to the first exemplary embodiment, attachment portions 32 made of molded resin are formed at both ends of the light emission device 30. As shown in FIG. 3 (enlarged view), a screw hole 38 may be formed in each attachment portion 32. When the screw holes 38 are provided, the light emission device 30 in which the organic EL panel 10 is shaped in a curved state by the molding resin can be directly mounted on a lamp body without a frame or the like and can be used as a lamp unit.

Figure 4A:
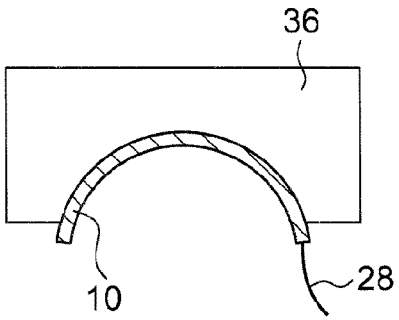
FIGS. 4A to 4C illustrate a process of manufacturing a light emission device according to a second exemplary embodiment.
Figure 4B:
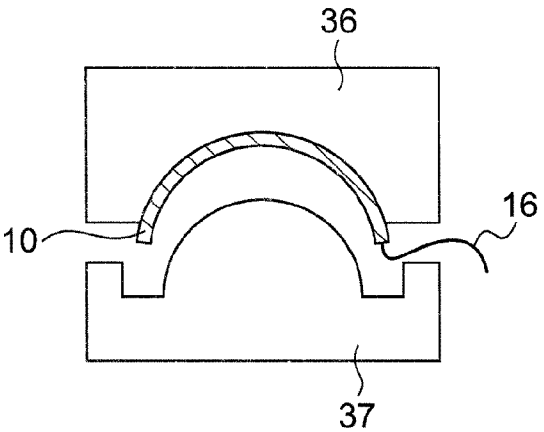
Figure 4C:
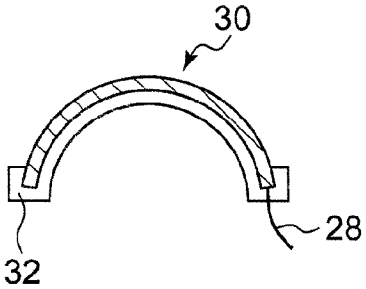

FIGS. 4A to 4C illustrate a process of manufacturing a light emission device according to a second exemplary embodiment.

At first, as shown in FIG. 4A, the organic EL panel 10 is placed in a female die 36 having a desired shape. Placing the organic EL panel 10 in the female die 36 may be done by vacuum suction through minute holes that are formed through a concave wall of the female die 36.

Subsequently, as shown in FIG. 4B, the female die 36 and the organic EL panel 10 are combined with a corresponding male die 37. A pouring gate (not shown) is formed through the male die 37, and liquid molding resin is poured into a space between the dies 36 and 37 through the pouring gate. In this case, the molding resin is a thermosetting resin such as an epoxy resin or a phenol resin or an ultraviolet-setting resin such as epoxy acrylate or urethane acrylate.

After the molding resin is filled, the dies 36 and 37 are heated or illuminated with ultraviolet light, whereby the molding resin is set (cured). Then, the dies 36 and 37 are removed. As a result, a light emission device 30 which is firmed in a curved state is obtained as shown in FIG. 4C.

When a rigid light emission device 30 is produced by shaping the organic EL panel 10 in the curved state by the molding resin as described above, the organic EL panel 10 which is in the curved state can be easily attached to a frame or the like of a lamp unit with high positional accuracy. Fixed firmly, the organic EL panel 10 can be prevented from being warped or damaged due to vibration of the lamp unit. When the organic EL panel 10 is incorporated in a vehicle lamp unit, it can be prevented that displacement of the organic EL panel 10 causes the vehicle lamp unit to fail to meet a luminous intensity prescribed by a related law or rule.

Since the power supply portions of the organic EL panel 10 are covered with the molding resin, the power supply portions can be protected physically and prevented from being corroded due to exposure to water coming from outside.

Figure 5A:
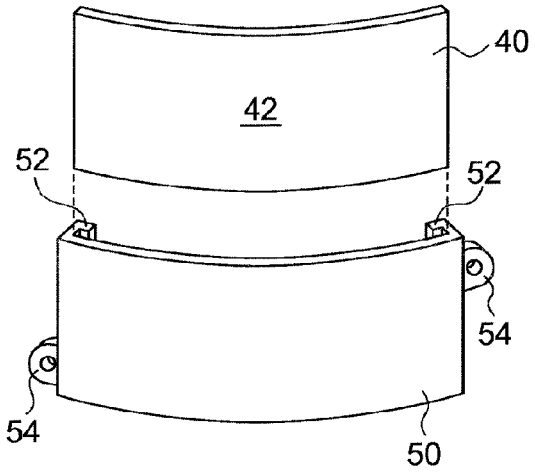
FIG. 5A illustrates a method for fixing to a frame a light emission device produced by either of the above manufacturing processes, according to a first example.

FIG. 5A illustrates a method for fixing a light emission device 40 which is produced in the above-described manner to a frame of a lamp unit, according to a first example.

A frame 50 has such a shape that the frame 50 is entirely curved with approximately the same curvature as the light emission device 40. The frame 50 is formed with recess portions 52 at both ends thereof to house both end portions of the light emission device 40. The frame 50 also includes tabs 54 each of which is formed through a through hole. The tabs 54 are used to fix the frame 50 to another member.

The light emission device 40 is inserted into the recess portions 52 so that a light emission surface 42 of the light emission device 40 is covered by the frame 50. Thereby, the light emission device 40 is fixed to the frame 50.

Figure 5B:
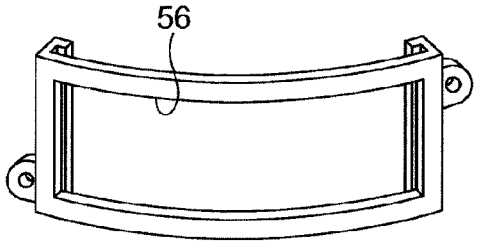
FIG. 5B shows another example of the frame for use in this method.

The entire frame 50 or a portion, corresponding to a light emission area of the light emission device 40, of the frame 50 is transparent or translucent and allows light to pass therethrough. Alternatively, as shown in FIG. 5B, the frame 50 may be opaque and have a window 56 that is formed by cutting out a portion, overlapping the light emission area of the light emission device 40, of the frame 50.

Figure 6:
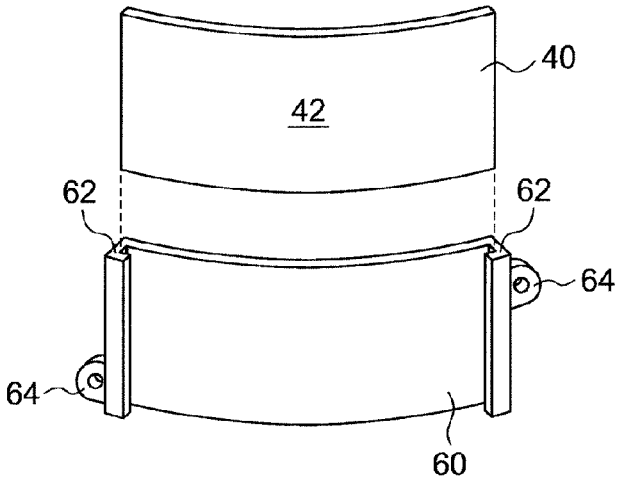
FIG. 6 illustrates a method for fixing a light emission device to a frame, according to a second example.

FIG. 6 illustrates a method for fixing the light emission device 40 to a frame of a lamp unit, according to a second example.

A frame 60 has such a shape that the frame 60 is entirely curved with approximately the same curvature as the light emission device 40. The frame 60 is formed with recess portions 62 at both ends to house both end portions of the light emission device 40. The frame 60 also includes tabs 64 each of which is formed through a through hole. The tabs 64 are used to fix the frame 60 to another member.

The light emission device 40 is inserted into the recess portions 62 so that a surface, opposite to the light emission surface 42, of the light emission device 40 is covered by the frame 60. Thereby, the light emission device 40 is fixed to the frame 60 so that the light emission surface 42 is exposed.

Figure 7:
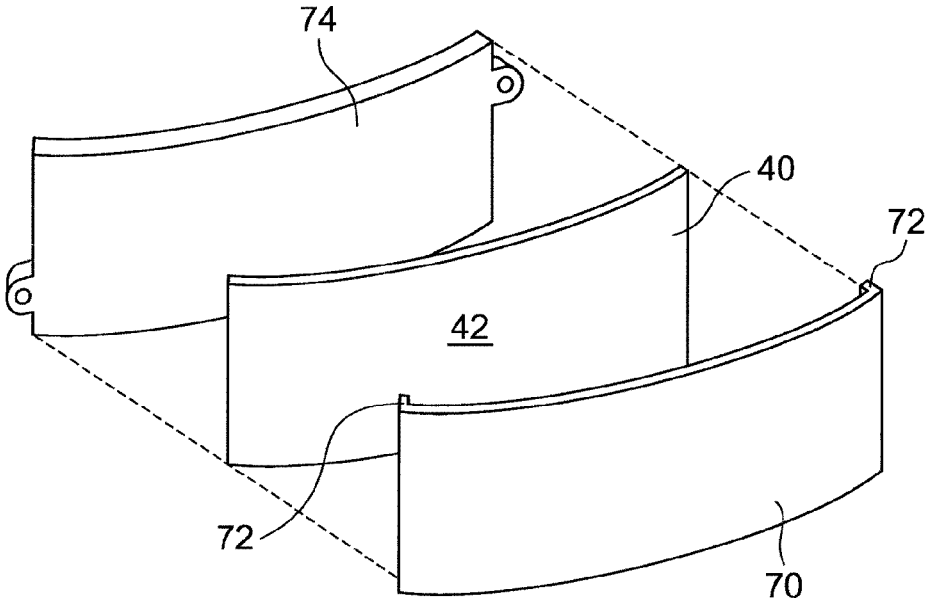
FIG. 7 illustrates a method for fixing a light emission device to a frame, according to a third example.

FIG. 7 illustrates a method for fixing the light emission device 40, according to a third example.

A cover 70 and a frame 74 have such shapes that the cover 70 and the frame 74 are entirely curved with approximately the same curvature as the light emission device 40. The light emission device 40 is fixed so as to be sandwiched between the cover 70 and the frame 74.

The entire cover 70 or a portion, corresponding to a light emission area of the light emission device 40, of the cover 70 is transparent or semitransparent and allows light to pass therethrough. The cover 70 includes protrusion portions 72 at both ends thereof so that the protrusion portions 72 cover both ends of the light emission device 40. The protrusion portions 72 are connected to the frame 74 by welding, bolding, thermal caulking, or the like. Alternatively, the cover 70 may be connected to the frame 74 by means of a fixing member such as a screw or a lance.

As in the fixing method shown in FIG. 5B, the cover 70 may be opaque and have a window that is formed by cutting out a portion, overlapping the light emission area of the light emission device 40, of the cover 70.

Figure 8A:
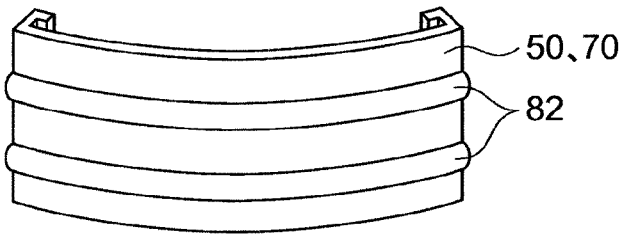
FIGS. 8A and 8B show modified examples of a frame.

As shown in FIG. 8A, a surface of the frame 50 which has been described with reference to FIG. 5 or a surface of the cover 70 which has been described with reference to FIG. 7 may be formed with protrusion portions 82. With this configuration, the frame 50 or the cover 70 is given a convex lens function to diffuse light emitted from the light emission device 40. Alternatively, the surface of the frame 50 or the cover 70 may be formed with recess portions. With this configuration, the frame 50 or the cover 70 is given a concave lens function to converge light emitted from the light emission device 40.

Figure 8B:
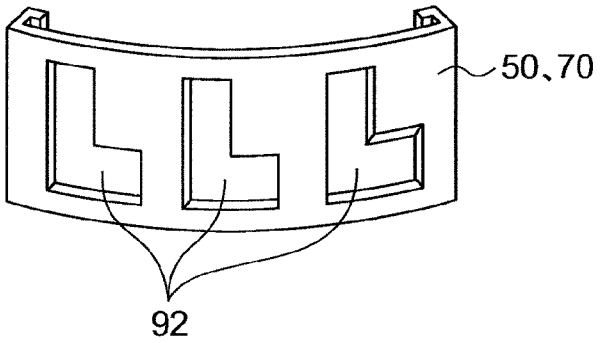

As shown in FIG. 8B, windows 92 having desirable shapes may be formed through the frame 50 (or the cover 70). This structure provides the frame 50 or the cover 70 with a high-quality design. In this case, the frame 50 or the cover 70 may be any of transparent one, smoky transparent one, and opaque one.

Figure 9:
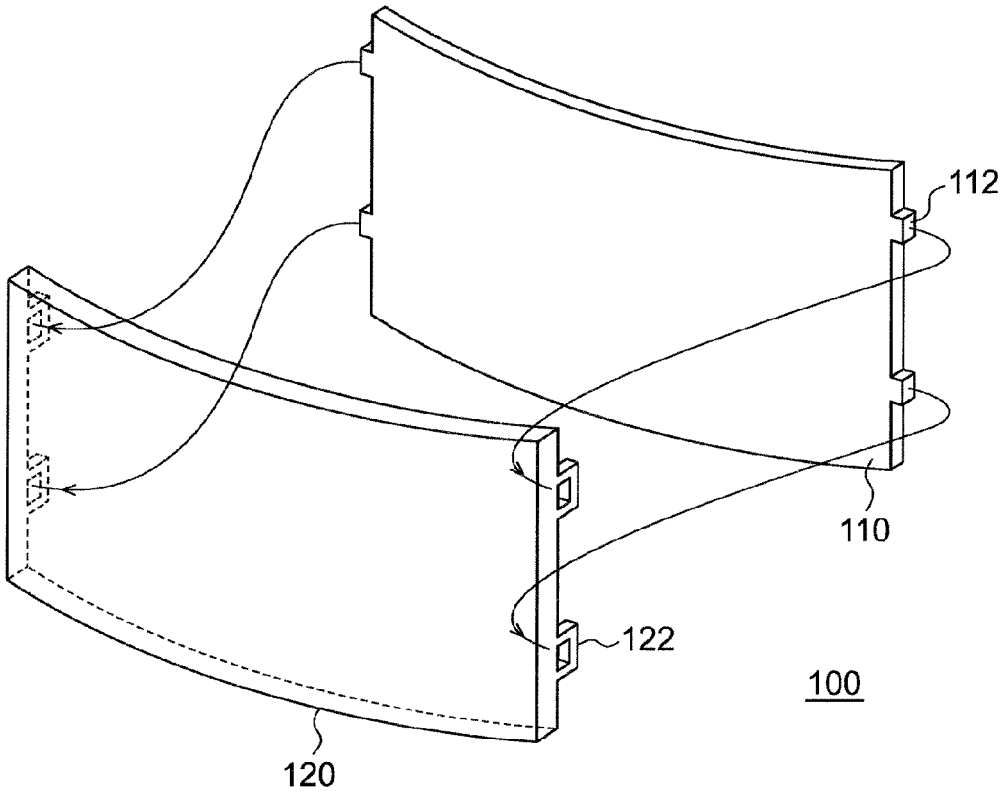
FIG. 9 shows a method for fixing a light emission device to a frame, according to a fourth example.

FIG. 9 shows a method for fixing a light emission device to a frame of a lamp unit, according to a fourth example.

Plural (in FIG. 9, four) attachment legs 112 which are made of molding resin are formed in circumferential edges of a light emission device 110 including an organic EL panel. The attachment legs 112 may be formed using the molding dies as shown in FIGS. 2A to 2C and 4A to 4C, by a cutting process after the light emission device 110 is shaped, or the like.

A frame 120 is curved with approximately the same curvature as the light emission device 110 and is slightly larger in external shape than the light emission device 110. The entire frame 120 or a portion, corresponding to a light emission area of the light emission device 110, of the frame 120 is transparent or translucent and allows light to pass therethough.

The frame 120 is formed with attachment holes 122 at positions corresponding to the attachment legs 112 of the light emission device 110. The attachment legs 112 of the light emission device 110 are fitted into the respective attachment holes 122 of the frame 120. Thereby, the light emission device 110 is fixed to the frame 120.

Conversely, a light emission device may be formed with attachment holes so that the attachment holes passes through both of the organic EL panel and the molding resin, and a frame may be formed with attachment legs configured to be fitted into the respective attachment holes. The attachment legs of the frame are fitted into the respective attachment holes of the light emission device, whereby the light emission device is fixed to the frame.

Figure 10:
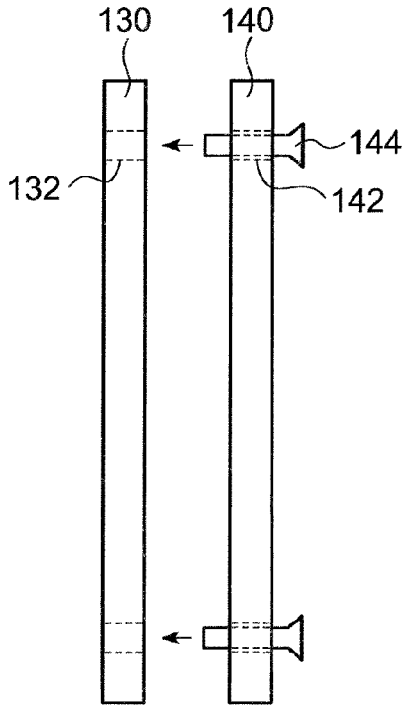
FIG. 10 illustrates a method for fixing a light emission device to a frame, according to a fifth example.

FIG. 10 illustrates a method for fixing a light emission device to a frame of a lamp unit, according to a fifth example.

Through holes 132 and through holes 142 are formed through a frame 130 and a light emission device 140, respectively, at such positions that the through holes 132 correspond to the respective through holes 142. Pins 144 are inserted into the respective pairs of through holes 132, 142, and both ends of each pin 144 are caulked. Thereby, the light emission device 140 is fixed to the frame 130.

Figure 11:
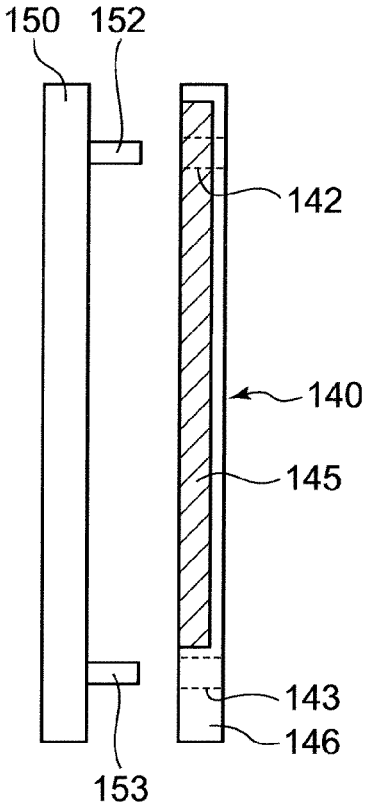
FIG. 11 illustrates a method for fixing a light emission device to a frame, according to a sixth example.

FIG. 11 illustrates a method for fixing a light emission device to a frame of a lamp unit, according to a sixth example.

A light emission device 140 includes an organic EL panel 145 and a molding resin 146. As shown in FIG. 11, the organic EL panel 145 is molded so as to be deviated to one side (in FIG. 11, upward) in the molding resin 146. As in the method of FIG. 10, through holes 142, 143 are formed through the light emission device 140. The upper through hole 142 is formed through both of the organic EL panel 145 and the molding resin 146. In general, an organic EL panel has, in a peripheral portion thereof, a non-light-emission area in which electrodes and the like are to be formed. The through holes 142 are formed in the non-light-emission area. The lower through hole 143 is formed only through the molding resin 146.

Positioning pins 152 and 153 are erected from the frame 150 at such positions as to correspond to the respective through holes 142, 143. The positioning pins 152 and 153 are inserted into the respective through holes 142, 143 and then, leading end portions of the positioning pins 152 and 153 are caulked. Thereby, the light emission device 140 is fixed to the frame 150.

Figure 12:
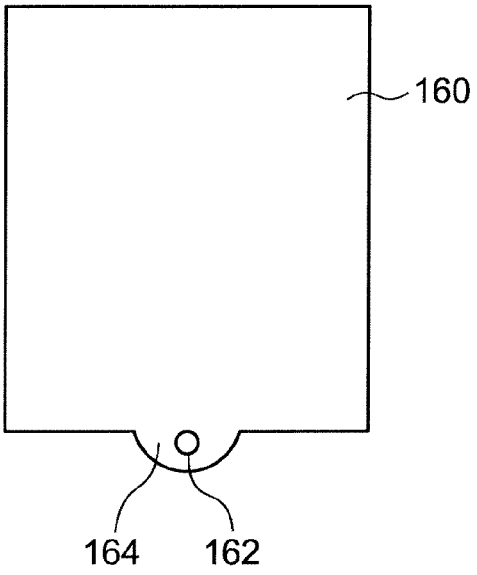
FIG. 12 illustrates a method for fixing a light emission device to a frame, according to a seventh example.

As shown in FIG. 12, a light emission device 160 may include a tab 164 which ptrodues from an outer edge of the light emission device 160. A screw hole or a bolt hole 162 is formed through the tab 164. The light emission device 160 is fixed to a frame with a screw or a bolt.

In FIGS. 10 to 12, the light emission devices 140, 160 are drawn like flat plates. However, even in the case where a light emission device is curved can also be fixed to a frame, the light emission device can be fixed to a frame by any of the above methods.

In the above described exemplary embodiments, a single light emission device is fixed to a single frame. However, plural light emission devices which are arranged side by side may be fixed to a single frame.

In the above described exemplary embodiments, the organic EL panel is rectangular in a plan view. However, an external shape of the organic EL panel, that is not limited thereto. The organic EL panel may have any shape. In the case where the organic EL panel has a shape other than a rectangle shape, a frame is formed so as to conform to the external shape of the organic EL panel.

For example, lamp units that are produced according to the above described exemplary embodiments can be used as vehicular clearance lamps, day lamps, turn signal lamps, tail lamps, stop lamps, etc.

What is claimed is:

1. A lamp unit comprising:

a light emission device comprising an organic EL panel in which an organic EL light emission portion is formed on a substrate, the organic EL panel being flexible; and a frame that fixes the light emission device so as to cover a light emission area of the organic EL panel, wherein the frame comprises a window or a transparent portion at least in a part of a portion, overlapping the light emission area, of the frame, and wherein the frame is formed with U-shaped recess portions at both ends thereof that extend in a rear direction away from a light emission direction of the light emission device, and that secure and house both end portions of the organic EL panel.

2. The lamp unit according to claim 1, wherein the frame comprises tabs, each of which is formed through a through hole, and wherein the tabs are configured to fix the frame to another member.

3. The lamp unit according to claim 1, wherein the transparent portion of the frame has a convex portion or a concave portion.

4. The lamp unit according to claim 1, wherein the frame has such a shape that the frame is entirely curved with approximately the same curvature as the organic EL panel.

5. A lamp unit comprising:

an organic EL panel in which an organic EL light emission portion is formed on a substrate, the organic EL panel being flexible; and an entire cover or a portion, corresponding to a light emission area of the organic EL panel, of the cover is transparent or semitransparent, the cover comprising protrusion portions at both ends thereof so that the protrusion portions cover both ends of the organic EL panel, and a frame, wherein the cover and the frame have such shapes that the cover and the frame are entirely curved with approximately the same curvature as the organic EL panel, and wherein the organic EL panel is fixed so as to be sandwiched between the cover and the frame.

* * * * *